US005937452A

United States Patent [19]

Brewer

[11] Patent Number: 5,937,452

[45] Date of Patent: Aug. 17, 1999

[54] PORTABLE BATHROOM ASSEMBLY

[76] Inventor: Byrl F. Brewer, 1421 E. Northcrest Dr., Highlands Ranch, Colo. 80126

[21] Appl. No.: 08/936,951

[22] Filed: Sep. 25, 1997

[51] Int. Cl.[6] ..... A47K 11/02

[52] U.S. Cl. ..... 4/460; 4/599; 4/483

[58] Field of Search ..... 4/460, 449, 476, 4/599–603, 483–484

[56] References Cited

U.S. PATENT DOCUMENTS

| | | | |
|---|---|---|---|
| 873,749 | 12/1907 | Herrick | 4/460 |
| 1,538,296 | 5/1925 | McDonald | 4/460 X |
| 1,538,311 | 5/1925 | Anticknap | 4/460 X |
| 1,563,236 | 11/1925 | Smith | 4/460 X |
| 1,567,484 | 12/1925 | Beard | 4/460 X |
| 1,574,339 | 2/1926 | Bush | 4/460 |
| 1,828,147 | 10/1931 | Kamman | 4/599 X |
| 5,544,369 | 8/1996 | Roberts | 4/603 X |

*Primary Examiner*—Charles E. Phillips

[57] ABSTRACT

A portable toilet assembly is provided including a rigid frame assembly. Next provided is a flexible tent assembly removably coupled about the rigid frame. Next provided is a toilet seat removably situated within the rigid frame.

1 Claim, 2 Drawing Sheets

PORTABLE BATHROOM ASSEMBLY

BACKGROUND OF THE INVENTION

1. Field of the Invention

The present invention relates to hunting blinds and more particularly pertains to a new portable bathroom assembly for allowing a user to perform bathroom duties in areas where plumbing is unavailable.

2. Description of the Prior Art

The use of hunting blinds is known in the prior art. More specifically, hunting blinds heretofore devised and utilized are known to consist basically of familiar, expected and obvious structural configurations, notwithstanding the myriad of designs encompassed by the crowded prior art which have been developed for the fulfillment of countless objectives and requirements.

Known prior art hunting blinds include U.S. Pat. No. 4,380,836; U.S. Pat. No. 4,974,265; U.S. Pat. Des. 353,946; U.S. Pat. No. 4,682,436; U.S. Pat. No. 4,761,908; and U.S. Pat. No. 4,825,578.

In these respects, the portable bathroom assembly according to the present invention substantially departs from the conventional concepts and designs of the prior art, and in so doing provides an apparatus primarily developed for the purpose of allowing a user to perform bathroom duties in areas where plumbing is unavailable.

SUMMARY OF THE INVENTION

In view of the foregoing disadvantages inherent in the known types of hunting blinds now present in the prior art, the present invention provides a new portable bathroom assembly construction wherein the same can be utilized for allowing a user to perform bathroom duties in areas where plumbing is unavailable.

The general purpose of the present invention, which will be described subsequently in greater detail, is to provide a new portable bathroom assembly apparatus and method which has many of the advantages of the hunting blinds mentioned heretofore and many novel features that result in a new portable bathroom assembly which is not anticipated, rendered obvious, suggested, or even implied by any of the prior art hunting blinds, either alone or in any combination thereof.

To attain this, the present invention generally comprises a frame assembly including four elongated telescoping rods. Each of such rods is adapted to be transferred between an extended orientation and a retracted orientation. Each telescoping rod has a rotatable coupling mechanism for locking the rods in the of the orientations. The frame further includes four short interconnection rods of a similar length. A plurality of connectors are included for releasably coupling ends of the interconnection rods together to define a square with four corners. Such connectors further releasably couple each corner of the square to an associated one of the top ends of the telescoping rods. A cross beam is releasably coupled between two of the interconnection rods with a vertical stub extending upwardly from a central extent thereof. During use, the telescoping rods are situated vertically on the ground with the square situated thereabove. As shown in FIGS. 1 & 2, a tent assembly is provided including four flexible rectangular sides and a flexible pyramid shaped top defining an open bottom. The tent assembly is adapted to removably cover the frame such that each sides edge of rectangular side is contiguous with an associated one of telescoping rods of the frame assembly. For receiving a stake when the tent assembly is covering the frame, each of the rectangular sides has a closed loop coupled to each of the bottom corners thereof. The top of the tent assembly has an eyelet formed in each of the corners thereof for coupling with an end of a support rope which is in turn coupled to the ground via an associated stake. One of the rectangular sides has a rectangular mesh portion situated therein adjacent the top of the tent assembly. Note FIG. 2. The mesh portion further has a flexible cover flap coupled along a top edge thereof. For allowing the securement of the cover flap in a rolled orientation, a pair of coupling strips are coupled to a top edge and bottom edge of the cover flap. As shown in FIG. 1, one of the rectangular sides of the tent assembly has a vertically oriented slit with an associated zipper for allowing the selective closure thereof thereby affording a closeable entrance to the frame and tent assembly. With reference now to FIG. 3, a toilet paper holder is shown. Such toilet paper holder includes a wire shaped in a closed loop configuration. The holder is coupled to the rotatable coupling mechanism of one of the telescoping rods of the frame. A roll of toilet paper is rotatably coupled to the wire. Finally, a collapsible toilet seat is included. As shown in FIG. 4, the seat includes a generally planar square platform with an opening formed in a central extent thereof. The opening has a beveled peripheral edge. Further, the opening is defined by a first circular portion of a first diameter and a second circular portion in communication with the first circular portion and having a second diameter less than the first diameter. The toilet seat further has four stanchions each with a top end coupled to a bottom surface of the platform adjacent an associated one of the corners thereof. Each of the stanchions extend downwardly and outwardly from the platform. Each of the stanchions has a bottom end with a disk coupled thereto. A spike is coupled to a bottom of the disk and extended downwardly therefrom thereby engaging the ground. The toilet seat further includes a splash shield coupled to the bottom surface of the platform and extends downwardly therefrom for protecting legs of a user during use of the toilet seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable bathroom assembly apparatus and method which has many of the advantages of the hunting blinds mentioned heretofore and many novel features that result in a new portable bathroom assembly which is not anticipated, rendered obvious, suggested, or even implied by any of the prior art hunting blinds, either alone or in any combination thereof.

It is another object of the present invention to provide a new portable bathroom assembly which may be easily and efficiently manufactured and marketed.

It is a further object of the present invention to provide a new portable bathroom assembly which is of a durable and reliable construction.

An even further object of the present invention is to provide a new portable bathroom assembly which is susceptible of a low cost of manufacture with regard to both materials and labor, and which accordingly is then susceptible of low prices of sale to the consuming public, thereby making such portable bathroom assembly economically available to the buying public.

Still yet another object of the present invention is to provide a new portable bathroom assembly which provides in the apparatuses and methods of the prior art some of the advantages thereof, while simultaneously overcoming some of the disadvantages normally associated therewith.

Still another object of the present invention is to provide a new portable bathroom assembly for allowing a user to perform bathroom duties in areas where plumbing is unavailable.

Even still another object of the present invention is to provide a new portable bathroom assembly that includes a rigid frame assembly. Next provided is a flexible tent assembly removably coupled about the rigid frame. Next provided is a toilet seat removably situated within the rigid frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
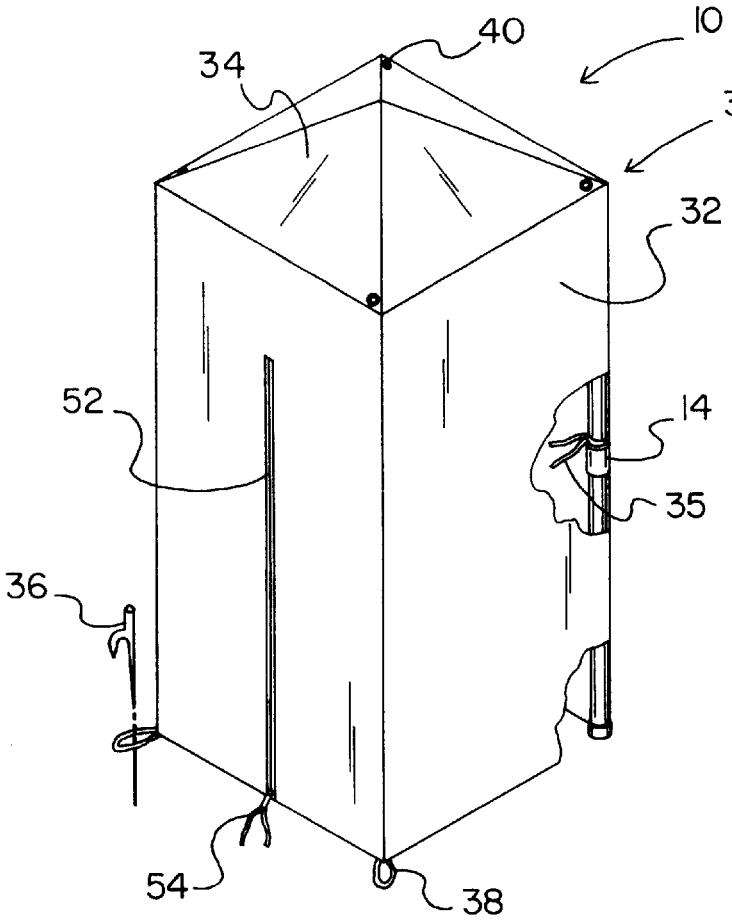
FIG. 1 is a perspective view of a new portable bathroom assembly according to the present invention.

With reference now to the drawings, and in particular to FIGS. 1 through 4 thereof, a new portable bathroom assembly embodying the principles and concepts of the present invention and generally designated by the reference numeral 10 will be described.

The system 10 of the present invention includes a frame assembly 12 comprising four elongated telescoping rods. Each of such rods is adapted to be transferred between an extended orientation and a retracted orientation. Each telescoping rod has a rotatable coupling mechanism 14 for locking the rods in one of the orientations. The frame further includes four short interconnection rods 16 of a similar length. A plurality of connectors 17 are included for releasably coupling ends of the interconnection rods together to define a square 18 with four corners 20. Such connectors further releasably couple each corner of the square to an associated one of the top ends of the telescoping rods. To accomplish such, the connectors include an L-shaped tube 22 residing in a horizontal plane with a tubular extension 24 coupled thereto and extending perpendicularly therefrom.

A cross beam 26 is releasably coupled between two of the interconnection rods with a vertical stub 28 extending upwardly from a central extent thereof. Such coupling is afforded by a connector defined by a T-shaped tubes. During use, the telescoping rods are situated vertically on the ground with the square situated thereabove.

Figure 2:
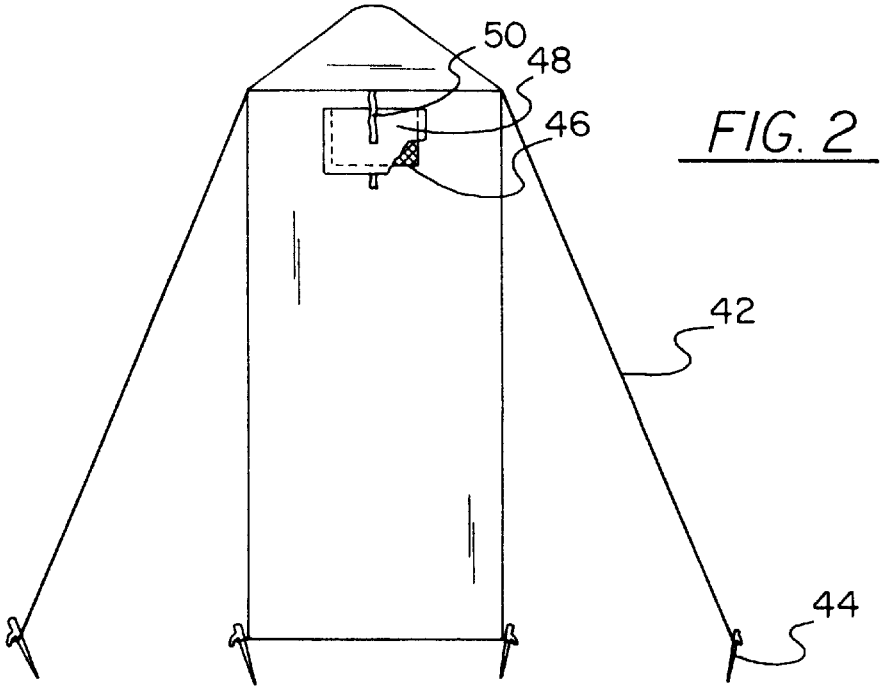
FIG. 2 is a rear view of the present invention.

As shown in FIGS. 1 & 2, a tent assembly 30 is provided including four flexible rectangular sides 32 and a flexible pyramid shaped top 34 defining an open bottom. The tent assembly is adapted to removably cover the frame such that each sides edge of rectangular side is contiguous with an associated one of telescoping rods of the frame assembly. To prevent the removal of the tent assembly during use, a pair of coupling strings 35 are coupled to an interior surface of each of the side edges of the rectangular sides.

For receiving a stake 36 when the tent assembly is covering the frame, each of the rectangular sides has a closed loop 38 coupled to each of the bottom corners thereof. The top of the tent assembly has an eyelet 40 formed in each of the corners thereof for coupling with an end of a support rope 42 which is in turn coupled to the ground via an associated stake 44. Such stake 44 is preferably inserted within the ground at a point spaced from the tent and frame assemblies.

One of the rectangular sides has a rectangular mesh portion 46 situated therein adjacent the top of the tent assembly. Note FIG. 2. The mesh portion further has a flexible cover flap 48 coupled along a top edge thereof. For allowing the securement of the cover flap in a rolled orientation, a pair of coupling strips 50 are coupled to a top edge and bottom edge of the cover flap. As shown in FIG. 1, one of the rectangular sides of the tent assembly has a vertically oriented slit 52 with an associated zipper 54 for allowing the selective closure thereof thereby affording a closeable entrance to the frame and tent assembly.

Figure 3:
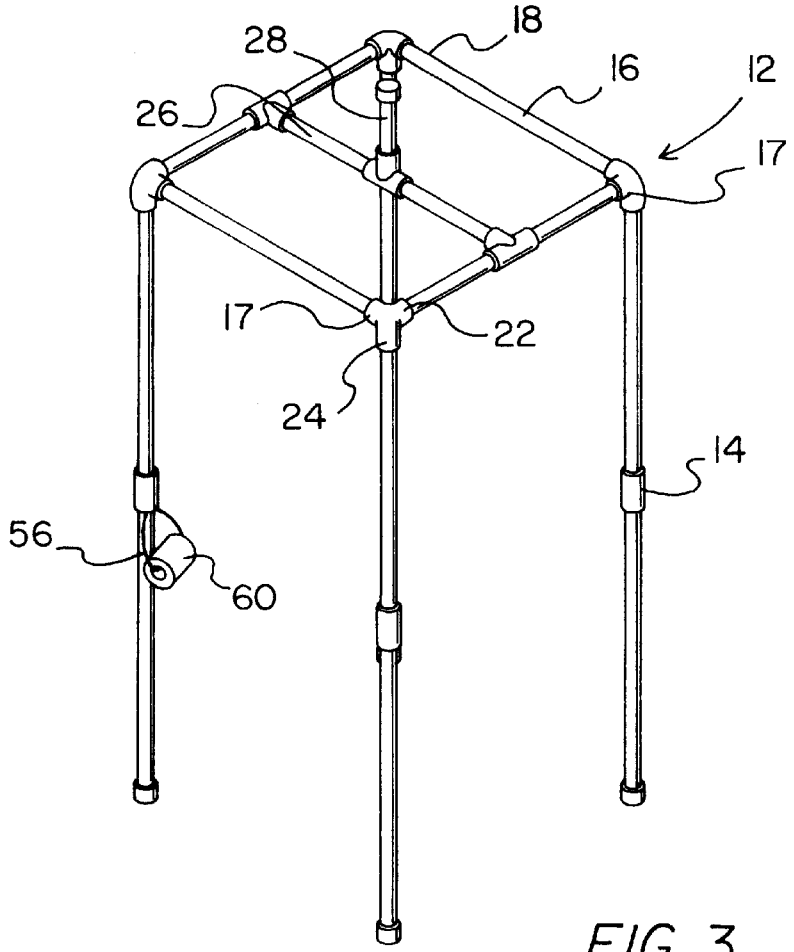
FIG. 3 is a perspective view of the frame of the present invention.

With reference now to FIG. 3, a toilet paper holder 56 is shown. Such toilet paper holder includes a wire 58 shaped in a closed loop configuration. The holder is removably coupled to the rotatable coupling mechanism of one of the telescoping rods of the frame. Such removably coupling may be accomplished by way of a hook and loop coupling or the like. By this structure, the wire 58 may be connected to any one of the rotatable coupling mechanisms. In use, a roll of toilet paper 60 is rotatably coupled to the wire.

Figure 4:
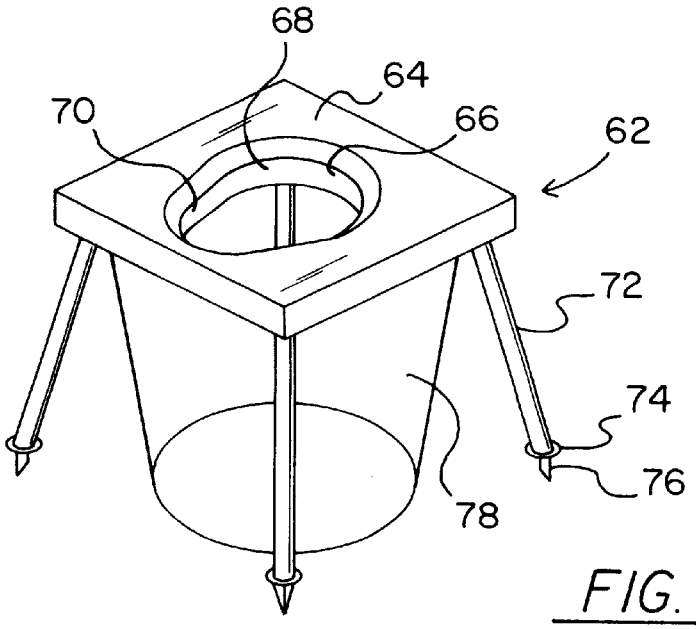
FIG. 4 is a perspective view of the collapsible toilet seat assembly of the present invention.

Finally, a collapsible toilet seat 62 is included. As shown in FIG. 4, the seat includes a generally planar square platform 64 with an opening formed in a central extent thereof. The opening has a beveled peripheral edge 66. Further, the opening is defined by a first circular portion 68 of a first diameter and a second circular portion 70 in communication with the first circular portion and having a second diameter less than the first diameter. The toilet seat further has four stanchions 72 each with a top end coupled to a bottom surface of the platform adjacent an associated one of the corners thereof. Each of the stanchions extend downwardly and outwardly from the platform. Each of the stanchions further has a bottom end with a disk 74 coupled thereto. A spike 76 is coupled to a bottom of the disk and extends downwardly therefrom for engaging the ground.

The toilet seat further includes a splash shield 78 coupled to the bottom surface of the platform and extended downwardly therefrom for protecting legs of a user during use of the toilet seat. While the splash shield may be formed of a flexible cylindrical or frusto conical shield, it should be understood that, in the alternative, a square flap may be hingably coupled along a front edge of the platform.

While not shown, it should be noted that upon the collapsing of the frame assembly, tent assembly, and toilet seat, the frame and tent assemblies may be stored in a duffel bag type container. Further, a suitcase-type bag container may be employed to contain the toilet seat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable toilet assembly comprising, in combination:

a frame assembly including four elongated telescoping rods each adapted to be transferred between an extended orientation and a retracted orientation, with each telescoping rod having a rotatable coupling mechanism for locking the rods in one of the orientations, the frame assembly further including four short interconnection rods of a similar length, a plurality of connectors for releasably coupling ends of the interconnection rods together to define a square with four corners with the connectors further releasably coupling each corner of the square to an associated one of the top ends of the telescoping rods, and a cross beam releasably coupled between two of the interconnection rods with a vertical stub extending upwardly from a central extent thereof, whereby the telescoping rods are situated vertically on the ground with the square situated thereabove;

a tent assembly including four flexible rectangular sides and a flexible pyramid shaped top defining an open bottom, the tent assembly adapted to removably cover the frame assembly such that each sides edge of rectangular side is contiguous with an associated one of telescoping rods of the frame assembly, each of the rectangular sides having a closed loop coupled to each of the bottom corners thereof for receiving a stake when the tent assembly is covering the frame assembly, the top of the tent assembly having an eyelet formed in each of the corners thereof for coupling with an end of a support rope which is in turn coupled to the ground via an associated stake, one of the rectangular sides having a rectangular mesh portion situated therein adjacent the top of the tent assembly, the mesh portion further having a flexible cover flap coupled along a top edge thereof with a pair of coupling strips coupled to a top edge and bottom edge of the cover flap for allowing the securement of the cover flap in a rolled orientation, one of the rectangular sides of the tent assembly having a vertically oriented slit with an associated zipper for allowing the selective closure thereof thereby affording a closeable entrance to the frame assembly and tent assembly;

a toilet paper holder including a wire shaped in a closed loop configuration and coupled to the rotatable coupling mechanism of one of the telescoping rods of the frame assembly, wherein a roll of toilet paper is rotatably coupled to the wire; and a collapsible toilet seat including a generally planar square platform with an opening formed in a central extent thereof, the opening having beveled side edges and defined by a first circular portion of a first diameter and a second circular portion in communication with the first circular portion and having a second diameter less than the first diameter, the toilet seat further including four stanchions each having a top end coupled to a bottom surface of the platform adjacent an associated one of the corners thereof and extending downwardly and outwardly therefrom, each of the stanchions having a bottom end with a disk coupled thereto and a spike coupled to a bottom of the disk and extending downwardly therefrom thereby engaging the ground, the toilet seat further including a splash shield coupled to the bottom surface of the platform and extending downwardly therefrom for protecting legs of a user during use of the toilet seat.

* * * * *